US005489753A

United States Patent [19]

Gibel

[11] Patent Number: 5,489,753

[45] Date of Patent: Feb. 6, 1996

[54] STATIC DISSIPATIVE MUFFLER

[75] Inventor: Steve Gibel, North Royalton, Ohio

[73] Assignee: Allied Witan Company, North Royalton, Ohio

[21] Appl. No.: 273,321

[22] Filed: Jul. 11, 1994

[51] Int. Cl.[6] ..... F01N 3/02

[52] U.S. Cl. ..... 181/230; 181/256; 181/277; 181/278

[58] Field of Search ..... 181/226, 230, 181/236, 237, 254, 277, 278, 282, 256

[56] References Cited

U.S. PATENT DOCUMENTS

| | | | |
|---|---|---|---|
| 1,747,014 | 2/1930 | Kersey | 181/278 |
| 2,815,088 | 12/1957 | Gibel | 181/230 |
| 3,292,732 | 12/1966 | Webb | 181/226 |
| 3,380,553 | 4/1968 | Gibel | 181/230 |
| 4,903,486 | 2/1990 | Finkle | 181/237 X |

*Primary Examiner*—Khanh Dang
*Attorney, Agent, or Firm*—Lightbody & Lucas

[57] ABSTRACT

An auto-adjusting damper assembly for an air muffler, such assembly including a spring loaded damper plate located above an outlet hole for transferring some of the energy of incoming air into a mechanical movement of such damper.

8 Claims, 2 Drawing Sheets

STATIC DISSIPATIVE MUFFLER

FIELD OF THE INVENTION

This invention relates to an air exhaust muffler having a shock absorbing damper in an expansive chamber from which the exhaust air is dispersed at reduced velocity through openings in a surrounded disseminator.

BACKGROUND OF THE INVENTION

The present invention is described in its preferred embodiment as an improvement of Gibel U.S. Pat. No. 3,380,553 issued Apr. 30, 1968 ('553 patent). In this device, the dissipation of exhaust noise takes place in a silencing chamber defined in part by a porous or perforated cylinder wall through which the air is dispersed radially relatively free of noise. While the effectiveness of this air exhaust muffler has been thoroughly established in many plants around the world as an effective control of air exhaust noise from air cylinders, valves, tools, hoists, clutches, and other operating devices, there are certain maintenance requirements which must be met in order for the air exhaust muffler to maintain its designed operating parameters. In addition there are certain operating conditions in which the air exhaust muffler will not operate for its full designed service life. As an example of the former, the porous material or the disseminator must be replaced at periodic intervals, something that can be omitted or overlooked by maintenance personnel, especially when the air muffler is used with an overhead hoist or is in an otherwise inaccessible, unviewable position. As an example of the latter, even in closed loop air systems, contaminants will build up within the air lines, contaminants which can in a very short period plug up the disseminator, this even though the disseminator is otherwise no where near the end of its operating service life measured purely by hours in service. In addition certain operating conditions, such as coal mines and cotton mills, present unusual hazards for the air muffler design. These unusual conditions can result in increased back pressure for the air exhaust muffler, extremely short life, and occasionally the physical destruction of the disseminator due to a physical blow out.

This invention can also be utilized with other mufflers.

OBJECTS AND SUMMARY OF THE INVENTION

It is an object of the present invention to increase the usability of air exhaust mufflers.

It is another object of the present invention to increase the operating longevity of air exhaust mufflers.

It is yet another object of the present invention to provide a muffler which will continue to operate with a plugged disseminator.

It is still another object of the present invention to absorb the energy of inlet air with a physically moving part.

It is a further object of the present invention to equalize the pressure within an air exhaust muffler.

It is yet still another object of the present invention to provide for integral pressure release in an air exhaust muffler.

Other objects and a more complete understanding of the invention may be had by referring to the following description and drawings in which:

BRIEF DESCRIPTION OF THE DRAWINGS

The structure, operation, and advantages of the presently disclosed preferred embodiment of the invention will become apparent in consideration of the following description taken in conjunction with the accompanying drawings wherein.

DETAILED DESCRIPTION OF THE INVENTION

Figure 1:
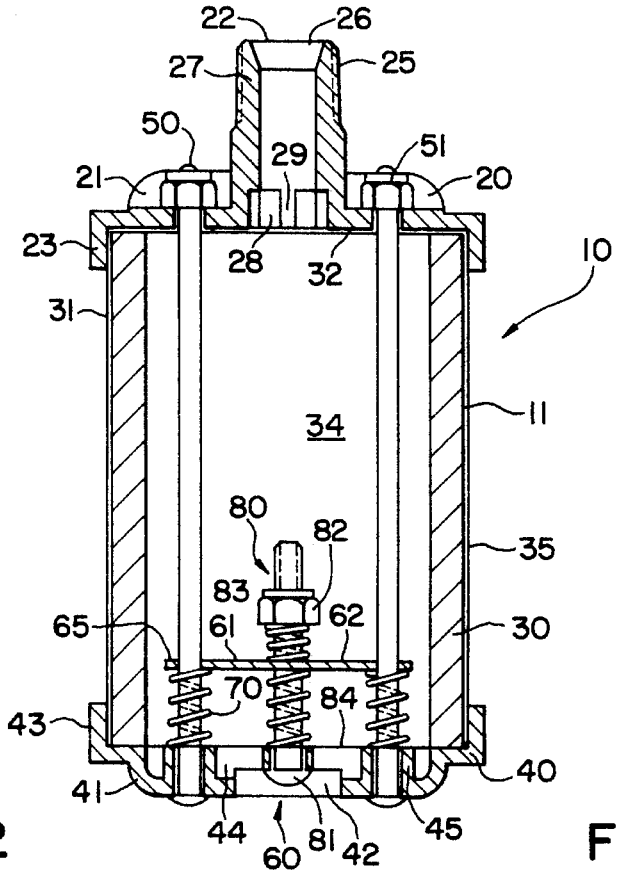
FIG. 1 is a longitudinal cross sectional view of an air exhaust muffler incorporating the invention of the application.
Figure 2:
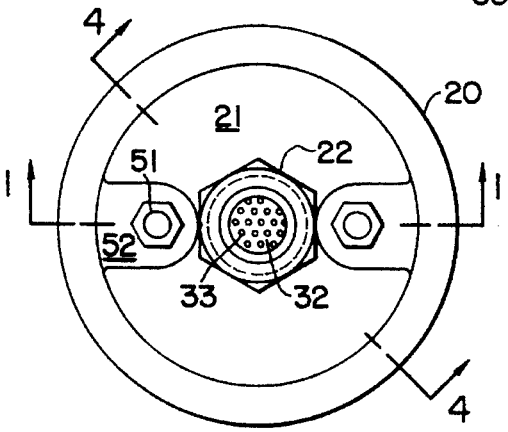
FIG. 2 is an inlet end view of the muffler of FIG. 1.
Figure 3:
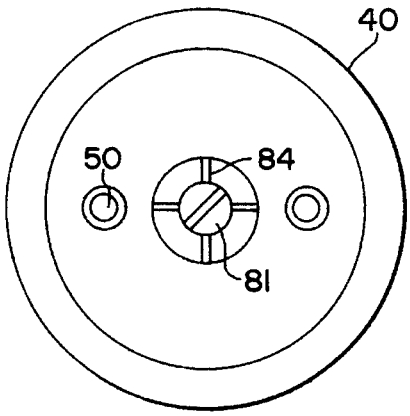
FIG. 3 is an outlet end view of the outlet end of the air muffler of FIG. 1; and, FIG. 4 is an inlet end view of the muffler of FIG. 1 taken substantially along lines 4—4 in FIG. 2.
Figure 4:
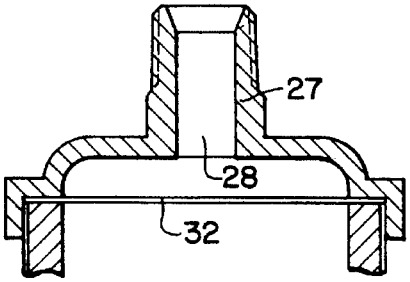

The invention relates to an automatic adjusting damper for use in a muffler.

The invention will be described in its preferred embodiment in combination with a static dissipative air exhaust muffler. The particular muffler utilized is the Allied Witan Air Exhaust Muffler EP type single chamber disclosed in principle in the Gibel '553 patent which is incorporated by reference as typical of the overall design.

The automatic shock absorbing damper invention is utilized in a muffler having an otherwise enclosed body. The Allied Witan muffler 10 shown has a first end cover 20, a hollow porous body member or disseminator 30, and a second end cover 40 retained together as an integral unit by longitudinally extending rods 50. The auto adjusted damper assembly 60 is located within the muffler 10 to operate as will be later described.

The first end cover 20 of the muffler 10 serves to form part of the overall muffler housing 11 as well as physically interconnecting such housing to a source of incoming non-noise reduced air as from an air cylinder, valve, or other air operated device.

The particular end cover 20 disclosed includes a flat body 21 generally circular in shape having an input pipe 22 extending off of one side thereof and a cylindrical flange 23 extending off the outer edge of the flat body thereof.

The input pipe 22 shown serves simultaneously to physically attach the housing 11 of the muffler 10 as well as providing an inlet passageway for the incoming air. This is preferred over separate means. In the particular embodiment disclosed, the method of attaching the housing 11 comprises exterior threads 25 on the end of the input pipe 22 while the inlet passageway 26 comprises a substantially uniform diameter hole 27 extending down the center of such input pipe. For reasons that are later described, the hole 27 has an enlarged area 28 immediately adjoining the opposite side of the flat body 21. This enlarged area 28 encompasses most of the surface area of the flat body 21 and later described diffuser disc, minus primarily the reinforcing areas 52 around the nuts 51 and narrow the supporting web 29 extending across the flat area 21 substantially 90° in respect to the reinforcing areas 52.

The cylindrical flange 23 on the opposite side of the flat body 21 serves to cooperate with the outer diameter 31 of the disseminator in order to interconnect the two in a leakproof manner. In addition, in the particular embodiment disclosed, there is a diffuser disc 32 having a plurality of small holes 33 located trapped between the flat body 21 and the end of the disseminator 30. This diffuser disc 32 in combination with the enlarged area 28 serves to reduce the velocity of the air by spreading it out over a larger area. In addition, the diffuser 32 initially absorbs the shock wave and then provides for a laminar flow of the incoming air over substantially the complete cross section of the disseminator. Note that in the present invention, the aggregate surface area of the holes 33 through the diffuser 32 in the enlarged area 28 is greater than the cross sectional area of the hole 27. The diffuser 32 lowers the velocity of the incoming air and spreads it out over a large area. Substantially 50% of the aggregate surface area of the plate 32 is formed by holes 33.

The disseminator 30 forms the bulk of the silencing expansion chamber 34 in addition to providing a filtering type outlet for the inlet air.

The particular disseminator 30 disclosed is a cylindrical tube made up of a porous material such as phenol-fiber. This disseminator allows air to impinge through the surface so as to absorb the energy upon impact, dissemination, and resonation. This particular disseminator is protected by a metal screen type reinforcing member 35 which surrounds it. A more complete explanation of the disseminator and reinforcing member may be had by referring to the '553 patent. The actual nature of the disseminator is not critical.

The second end cover 40 completes the housing 11 in addition to serving as a secondary outlet for the inlet air.

The particular second end cover 40 disclosed includes a flat body 41 generally circular in shape with an outlet passageway 42 extending through the center thereof, and a cylindrical flange 43 extending off the outer circumferential edge thereof.

The flat body 41 is for completing the housing 11 of the expansion chamber 34. As with the first end cover 20, a cylindrical flange 43 is located surrounding an end of the disseminator 30 so as to retain the parts and location and to minimize leakage at this particular point. Two closure rods 50 extend from the second end cover 40 to the first end cover 20 in order to complete physical construction of the housing 11 of the muffler 10 upon tightening of the nuts 51 on the exposed ends of such rods.

In a major point of deviation from the prior art, the second end cover 40 of the present invention includes an outlet passageway 42. The particular outlet passageway 42 disclosed is a circular hole in the center of the second end cover extending through the second end cover 40 into an enlarged area 44, an enlarged area that with the exception of two small rod guides 45 extends for the full cross sectional area of the inside of the disseminator 30. This outlet passageway 42 allows for inlet air to escape the expansion chamber 34 otherwise than through the porous walls of the disseminator 30. The cross section area of this outlet passageway 42 is substantially equal to or slightly less than the cross sectional area of the hole 27. The location of the outlet is not critical as long as it is beneath the initial positioning of the damper plate 61.

The flow of this air through the outlet passageway 42 is controlled by the auto adjusting damper assembly 60, which damper assembly also helps to mechanically absorb part of the energy of the inlet air.

The particular damper assembly 60 disclosed includes a damper plate 61, reaction springs 70, and an adjustment mechanism 80.

The damper plate 61 serves to physically impede the clear passage of air from the inlet passageway 26 to the outlet passageway 42 in addition to providing a physical surface for the initial translation of the energy of the incoming air into a mechanical movement.

The particular damper plate 61 disclosed is a generally cylindrical disc shaped member having a surface 62, which plate is located substantially perpendicular to the axis of the inlet passageway 26 near to the outlet passageway 42 for axial movement in respect thereto. The location near to the outlet passageway 42 is preferred so as to maximize the surface area of the disseminator 30 located between the inlet tube 27 and the damper plate 61. Two holes 65 through the surface 62 serve to locate the damper plate 61 in roughly in line with the inlet passageway 26 at the center of the tubular disseminator with the damper plate's outer edges slightly spaced from the inner surface of such disseminator. The aggregate cross sectional area of the space between the outer edge of the damper plate 61 and the inner diameter of the disseminator 30 is selected to be substantially equal to or slightly less than the aggregate cross sectional area for the hole 27. This allows for the maintenance of an increased pressure zone within the expansion chamber 34, thus to encourage incoming air to go outwardly through the walls of such disseminator.

The reaction springs 70 serve to provide a mechanical energy absorption device for the damper plate 61.

The particular reaction springs disclosed are three in number located symmetrically across the bottom side of the surface 62 of the damper plate 61 between such damper plate 61 and the second end cover 40. The strength of these reaction springs 70 are selected that for a given damper plate 61 and a given burst of incoming air, the damper plate 61 will not normally bottom against the rod guides 45, but will instead float on these reaction springs 70 slightly spaced from the rod guides 45. Further, the reaction springs 70 have a value such that upon cessation of the incoming burst of air and the maintenance of a lower velocity constant flow, the damper plate 61 will move upwards from the previous position to float some where above its maximum downward position, thus providing for a continuous translation of incoming air energy into mechanical energy. The particular location of this floating depends on the energy of the incoming air. In general, the higher the energy, the lower the damper plate 61 will float. Even with incoming air continuing, on complete equalization of pressure above/below the damper plate 61, such plate 61 will return to its initial position. The plate 61 should, however, customarily be downward of this position while air is incoming.

The adjustment screw mechanism 80 varies the timing and degree of mechanical absorption by the auto adjusting damper assembly 60. The adjustment screw mechanism 80 accomplishes this by artificially forcing the damper plate 61 downwards against the force of the reaction spring 70 so as to increase the amount of initial energy necessary to move such damper plate 61 further downwards.

In the particular embodiment disclosed, this adjustment is accomplished by tightening the screw 81 in respect to the nut 82. As the head of the screw 81 is held in position by small webs 84 to the second end cover 40, this adjustment has the effect of moving the nut 82 downwards in respect to the damper plate 61. As the damper plate 61 is moved downwards by the adjustment screw mechanism 80, it will take a higher amount of energy from the inlet air in order to initially move such damper plate 61 further downwards against the biased force of the reaction spring 70. This has the effect of increasing the amount of energy that will be necessary to initially move such damper plate 61. Conversely, letting off the adjustment screw mechanism 80 would eventually allow the reaction spring 70 to extend full length, thus lowering the force necessary to initially move the damper plate 61 downwards.

Figure 5:
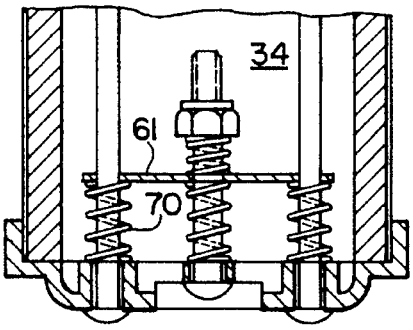
FIGS. 5–8 are partial sectional views of the longitudinal cross section of FIG. 1 highlighting the operation of the damper therein.
Figure 8:
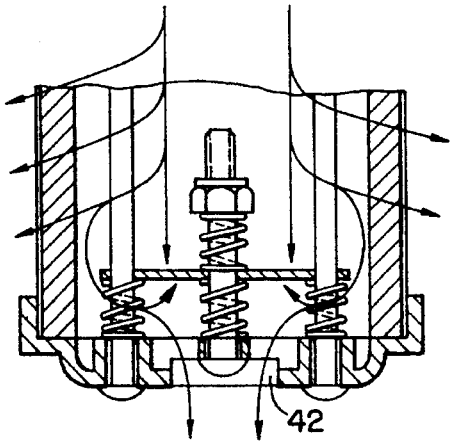

In the particular embodiment disclosed, an anti-chattering/retention spring 83 is located between the nut 82 and the surface 62 of the damper plate 61. This spring 83 has the effect of preventing the damper plate 61 from ever contacting the nut 82. This spring 83 also retains the head of the screw 81 against the webs 84 for all positions of the damper plate 61. To accomplish this, preferably the strength of this anti-chattering/retention spring 83 is selected such that it has about the same strength as each of the three reaction springs 70, thus insuring the operation of this anti-chattering/retention spring 83. With this preferred strength orientation, the spring 83 can be compressed while the springs 70 are substantially free length (i.e., no inlet air position; FIG. 5). In addition, even on full compression of the springs 70 due to incoming air energy, the spring 83 will maintain contact with the top of the damper plate 61, thus retaining the screw 81 in position (i.e., full deflection position; FIG. 8). The spring 83 itself, not subjected to upwards reverse forces beyond that of springs 70, normally does not ever bottom thus providing an anti-chattering/retention effect for the nut 82.

Figure 6:
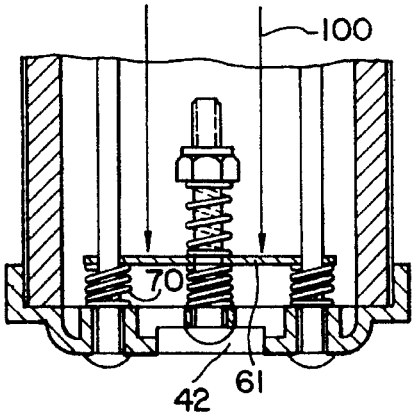
Figure 7:
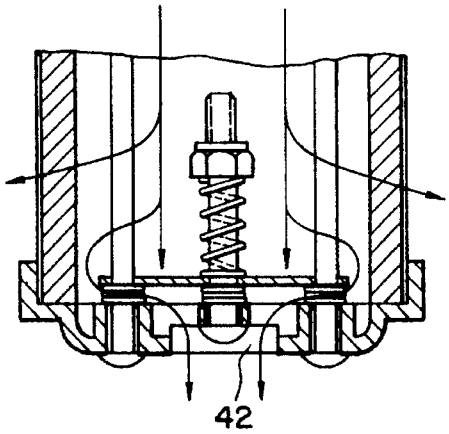

In operation, auto-adjusting damper assembly 60 of the muffler 10 is in its preset position and the expansion chamber 34 is unpressurized (FIG. 5). An intense burst 100 of air then travels through the inlet passageway 26 and the holes 33 in the diffuser 32 to the inside of the expansion chamber 34. As the direction of this air along the axis of the housing 11 is maintained, albeit spread out due to the diffuser 32, this air impinges upon the surface 62 of the damper plate 61 substantially across the full area thereof. This in turn causes the damper plate 61 to move downwards against the pressure of the reaction springs 70, thus transferring some of the energy of the inlet air into mechanical movement of the damper plate 61 (FIG. 6). While this is occurring, air within the expansion chamber 34 also begins dissipating through the outer surface area of the disseminator 30 and the outlet 42 (FIG. 7). Once the initial inlet burst has hit and dissipated on the damper plate 61, the subsequent positioning of the damper plate 61 will depend upon the pressure curve following the initial burst. For example, for a constant high pressure burst the damper plate 61 will move slightly upwards of its initial position (FIG. 8), with the amount that it moves upwards depending upon the relationship between the initial burst and the continuous air as well as the condition of the muffler 10 (i.e., the bigger the pressure differential and the better the muffler's condition, the higher the damper plate will move upwards). With low volumes of continuous air, the damper plate 61 will return substantially to its initial positioning despite the continuation of incoming air. This is subject, however, to the fact that as long as there is incoming air, this incoming air will impinge against the surface 62 of the damper plate 61 and thus transform at least part of its energy into mechanical dissipation. Upon cessation of the incoming air, the damper plate 61 will return to its initial position for reactivation of the next incoming burst (FIG. 5).

In addition to the above, there will be circumstances in which the flow through the disseminator 30 is restricted. This could occur for example if no maintenance is done on the air muffler, if the air muffler gets prematurely plugged, or for some other reason the pressure on the inside of the expansion chamber 34 is higher than designed. Under these circumstances, the incoming air is able to depart through the outlet passageway 42 up to its entirety, thus insuring the continual operation of the device with which the muffler is interconnected as well as the operation of the muffler, albeit at a reduced level of performance. The level of the damper plate 61 again would depend on the energy of the incoming air. Under these conditions, the damper plate 61 would be less likely to return to its initial positioning while air was incoming.

Although the invention has been described in its preferred embodiment with a certain degree of particularity, it is to be understood that numerous changes can be made without deviating from the invention as hereinafter claimed.

What is claimed

1. An improvement for a muffler used to reduce the noise of incoming air, the muffler having a generally cylindrical enclosed porous body closed at both ends by covers and an axis, one end cover having an inlet tube having a longitudinal axis, the improvement comprising an outlet, said outlet being in the second end cover, said outlet having a diameter, a damper plate, said damper plate being located inside of the muffler near to said outlet and between the inlet tube and said outlet, said damper plate having a surface, said surface having a diameter, said diameter of said surface being greater than said diameter of said outlet, guide means to movably mount said damper plate to the muffler for continual axial movement in respect thereto with said surface of said damper plate being substantially perpendicular to the axis of the inlet tube and reaction spring means connected to said damper plate to bias said damper plate away from the second end cover to continually absorb energy from the incoming air.

2. The improvement of claim 1 additionally comprising an adjustment screw, a hole in the second end cover, a second hole in the damper plate and said adjustment screw extending through said hole and said second hole to pretension said reaction spring means.

3. The improvement of claim 1 characterized in that said reaction spring means includes a spring and said spring extending between said damper plate and the non-inlet end cover.

4. The improvement of claim 1 wherein the muffler is held together by rods extending between the end covers and said guide means including the rods.

5. An improvement for a muffler used to reduce the noise of incoming air, the muffler having a generally cylindrical enclosed porous body closed at both ends by covers, one end cover having an inlet tube having a longitudinal axis, the muffler having two rods longitudinally extending between the covers to hold the muffler assembly together, the improvement comprising an outlet, said outlet being in the second end cover, said outlet being in line with the axis of the inlet tube, said outlet having a diameter, a damper plate, said damper plate having a surface, said surface having a diameter, said diameter of said surface being greater than said diameter of said outlet, said surface having two holes, said damper plate being located inside of the muffler near to said outlet and between the inlet tube and said outlet with the two rods extending through said two holes to movably mount said damper plate to the muffler with said surface of said damper plate being substantially perpendicular to the axis of the inlet tube and said reaction springs and said reaction springs extending between the second end cover and said damper plate to absorb energy from the incoming air.

6. The improvement of claim 5 additionally comprising an adjustment screw, a hole in the second end cover, a second hole in the damper plate and said adjustment screw extending through said hole and said second hole to pretension said reaction springs.

7. An improvement for a muffler, said muffler having a cylindrical porous open ended body member, an inlet cover, said inlet cover being mounted to said body member to close one end thereof, an inlet passageway, said inlet passageway being in said inlet cover, an outlet cover, said outlet cover being mounted to said body member to close the other end thereof, an outlet, said outlet being in said outlet cover, a plurality of connector rods, said connector rods extending between said inlet cover and said outlet cover through said body member to retain said covers to said body member, the improvement comprising, a damper plate, a plurality of holes in said damper plate, said damper plate being located within said body member near said outlet cover with said connector rods extending through said holes, a plurality of springs, and said plurality of springs being located surrounding said connector rods extending between said damper plate and said outlet cover.

8. The improvement of claim 7 additionally comprising an adjustment screw, a hole in the second end cover, a second hole in the damper plate and said adjustment screw extending through said hole and said second hole to pretension said plurality of springs.

* * * * *